US006040735A

United States Patent [19]

Park et al.

[11] Patent Number: 6,040,735

[45] Date of Patent: Mar. 21, 2000

[54] REFERENCE VOLTAGE GENERATORS INCLUDING FIRST AND SECOND TRANSISTORS OF SAME CONDUCTIVITY TYPE

[75] Inventors: Jong-min Park, Kyunggi-do; Tae-sung Jung, Seoul, both of Rep. of Korea

[73] Assignee: Samsung Electronics Co., Ltd., Rep. of Korea

[21] Appl. No.: 08/927,606

[22] Filed: Sep. 12, 1997

[30] Foreign Application Priority Data

Sep. 13, 1996 [KR] Rep. of Korea ..... 96-39902

[51] Int. Cl.[7] ..... G05F 1/10

[52] U.S. Cl. ..... 327/541; 327/543; 323/313

[58] Field of Search ..... 327/539, 540, 327/541, 543, 530; 323/313, 315

[56] References Cited

U.S. PATENT DOCUMENTS 5,109,187 4/1992 Guliani ..... 323/313

5,744,999 4/1998 Kim et al. ..... 327/543

FOREIGN PATENT DOCUMENTS 94-7298 8/1994 Rep. of Korea .

*Primary Examiner*—Kenneth B. Wells
*Assistant Examiner*—Minh Nguyen
*Attorney, Agent, or Firm*—Myers Bigel Sibley & Sajovec

[57] ABSTRACT

Reference voltage generators can be made relatively insensitive to variations in threshold voltages due to device fabrication processes by providing first and second transistors of the same conductivity type that are connected to one another and between first and second power supply voltages, such that the first transistor operates below the threshold voltage thereof and the second transistor operates above the threshold voltage thereof. The first transistor includes a gate that is coupled to a first node connected to a first power supply voltage and that is connected between an output reference voltage terminal and a second node that is connected to a second power supply voltage. The second transistor includes a gate that is coupled to the second node and is connected between the first node and the second power supply voltage.

8 Claims, 4 Drawing Sheets

REFERENCE VOLTAGE GENERATORS INCLUDING FIRST AND SECOND TRANSISTORS OF SAME CONDUCTIVITY TYPE

FIELD OF THE INVENTION

This invention relates to integrated circuit devices, and more particularly to integrated circuit reference voltage generators.

BACKGROUND OF THE INVENTION

With advances in integrated circuit design and fabrication, the integration densities of integrated circuit devices such as integrated circuit memory devices continue to increase. Operating voltages of the devices may also decrease. For example, in highly integrated memory devices, an operating voltage may be used in the integrated circuit that is lower than the external power supply voltage.

In order to obtain a stable internal power supply voltage, a reference voltage generator is often provided in an integrated circuit. In order to provide a stable reference voltage, it is generally desirable to provide a reference voltage generator that is relatively impervious to environmental effects that may be caused by operating temperature variations, fabrication process variations and external power supply voltage variations.

FIG. 1 illustrates a conventional reference voltage generator as described in Korean Patent Announcement Gazette, Number 94-7298. As shown in FIG. 1, the reference voltage generator includes first and second complementary field effect transistors 14 and 16 and a pair of resistors 10 and 12.

In particular, as shown in FIG. 1, the gate of N-type Metal Oxide Semiconductor (NMOS) field effect transistor 14 is connected to a reference voltage output terminal Vref that is formed by a first node 11 between resistors 10 and 12. As also shown, resistors 10 and 12 and the controlled electrodes of P-type MOS (PMOS) transistor 16 are connected between first and second power supply voltages Vcc and Vss. The second resistor and the PMOS transistor 16 define a second node 13 therebetween. The gate electrode of PMOS transistor 16 is connected to second node 13. The controlled electrodes of the PMOS transistor 16 are connected between the first node 11 and the second power supply voltage Vss. The substrate of the PMOS transistor 16 is also connected to the output terminal Vref at first node 11.

Analysis of the reference voltage generator of FIG. 1 will now be provided. In response to a power supply voltage Vcc, a current I10 that flows through resistor 10 is divided into current I12 through resistor 12 and current I16 through the channel of the PMOS transistor 16. The value of I10 is given by the following equation:

$$I10=(Vcc-Vref)/R10 \quad (1)$$

where R10 is the resistance value of resistor 10. Since NMOS transistor 14 is in saturation, I12 is defined by the following equation:

$$I12=(Vref-Vx)/R12=(\beta n/2)(Vref-Vtn)^2 \quad (2)$$

where Vx and Vtn are the voltage at node 13 and the threshold voltage of transistor 14 respectively, and βn is a constant determined by several factors such as the width and length of the channel of transistor 14, the carrier mobility and the thickness of the gate insulator of transistor 14.

PMOS transistor 16 generally has a large channel width and the voltage level at node 13 is generally lower than the voltage level at node 11 by the threshold voltage of the PMOS transistor 16. Thus, the PMOS transistor generally operates in the subthreshold region. The current I16 that passes through PMOS transistor 16 while in the subthreshold region may be defined as follows:

$$I16=Ido(W/L)EXP[Vg/nVT](EXP[-Vs/VT]-EXP[-Vd/VT]) \quad (3A)$$

where Ido is constant, W and L are channel width and length, and Vs, Vg and Vd are source-to-bulk voltage, gate-to-bulk voltage and drain-to-bulk voltage, of PMOS transistor 16, respectively. See for example, pages 124–127 of "*CMOS Analog Circuit Design*" by Phillip E. Allen et al.

If PMOS transistor 16 is operating in a saturation region as is NMOS transistor 14, and the drain-to-source voltage Vds is about 12 volts, then Equation 3A may be reduced to the following equation:

$$I16=Ido(W/L)EXP[(Vref-Vx)/nVT] \quad (3B)$$

where the exponential terms EXP[−Vs/VT]−EXP[−Vd/VT] become negligible because Vds is about 1.2 volts and is much larger than 3VT, where VT is kT/q. Accordingly, the voltage Vx at second node 13 may be given by:

$$Vx=Vref-((R12(\beta n/2)(Vref-Vtn)^2) \quad (4)$$

Since I10-I12=I16, the following equation may be obtained:

$$(Vcc-Vref)/R10-(\beta n/2)\ (Vref-Vtn)^2=Ido(W/L)EXP[R12(\beta n/2)(1/nVT)(Vref-Vtn)^2] \quad (5)$$

In the reference voltage generator of FIG. 1, NMOS transistor 14 and PMOS transistor 16 may compensate one another relative to variations of the power supply voltage Vcc. In particular, with increasing power supply voltage Vcc, the voltage Vref on first node 11 rises slightly to increase the values (Vcc−Vref)/R10 and $(\beta n/2)(Vref-Vtn)^2$ of Equation (5). The value of I10, (Vcc−Vref)/R10, increases greatly, while the value of I12, $(\beta n/2)(Vref-Vtn)^2$, increases slightly. However, the value of the left term of the Equation (5) also increases greatly. Also, in the right term of Equation (5), the increased Vref makes the value of the right term increase greatly so as to equal the value of the left term. FIG. 2 graphically illustrates variations in Vref as a function of variation of the power supply voltage from 2 V to 5 V.

The two transistors 14 and 16 may also compensate one another against temperature variations, as shown in FIG. 3. The overall compensation for variations of power supply voltage and temperature of the circuit of FIG. 1 are cumulatively described in FIG. 4, where plots A, B and C correspond to temperatures of 0° C., 25° C. and 100° C., respectively.

Unfortunately, however, as shown in FIG. 5, the threshold voltages of the NMOS and PMOS transistors 14 and 16 may vary widely due to variations in the fabrication process thereof. Thus, the voltage level on node 11, i.e. Vref, may not be stable, and may not be compensated by the two transistors 14 and 16. For example, FIG. 5 shows that Vref may change by about 0.5 volts when the threshold voltage of the NMOS transistor 14 varies by about ±0.05 volts. The CMOS manufacturing environment of the complementary transistors may produce process variations that are even higher, which may render the threshold voltages even more unstable, and which may change the reference voltage Vref even more.

SUMMARY OF THE INVENTION

It is therefore an object of the present invention to provided improved integrated circuit reference voltage generators.

It is another object of the present invention to provide integrated circuit reference voltage generators that can reduce susceptibility to variations in threshold voltage, temperature and/or power supply voltage.

These and other objects are provided, according to the present invention, by a reference voltage generator that includes first and second transistors of the same conductivity type. The first and second transistors of the same conductivity type are connected to one another, to a reference voltage output terminal and between first and second power supply voltages, to produce a reference voltage at the reference voltage output terminal. The reference voltage generator is preferably free of transistors of opposite conductivity type from the first and second transistors. Preferably, the first transistor operates above the threshold voltage thereof, and the second transistor operates below the threshold voltage thereof. A resistor biases the second transistor in a subthreshold region.

The two transistors can compensate one another for temperature and power supply voltage variations. Moreover, since the threshold voltages of the first and second transistors of the same conductivity type generally track one another, the reference voltage generator can also be relatively insensitive to parameter variations that may occur between complementary transistors in a CMOS fabrication process.

In particular, reference voltage generators according to the invention include first and second transistors of same conductivity type, each having a controlling electrode such as a gate, and a pair of controlled electrodes such as a source and a drain. The reference voltage generator also includes first and second nodes, a respective one of which is connected to respective first and second power supply voltages. The controlled electrodes of the first transistor are connected between a reference voltage output terminal and the second node. The controlled electrodes of the second transistor are connected between the first node and the second power supply voltage. The controlling electrode of the first transistor is connected to the first node and the controlling electrode of the second transistor is connected to the second node. A resistor connected between the second node and the second power supply voltage, biases the second transistor in a subthreshold region.

A more specific embodiment of the present invention provides first and second transistors of the same conductivity type, each having a controlling electrode (gate), and a pair of controlled electrodes (source/drain). First, second and third resistors are also provided. The first and second resistors, the controlled electrodes of the first transistor and the third resistor are serially connected between first and second power supply voltages to define a first node between the first and second resistors, a reference voltage output terminal between the second resistor and the first transistor, and a second node between the first transistor and the third resistor. The controlling electrode of the first transistor is connected to the first node, and the controlling electrode of the second transistor is connected to the second node. The controlled electrodes of the second transistor are serially connected between the first node and the second power supply voltage. The third resistor biases the second transistor in a subthreshold region.

Preferably, the first and second transistors are first and second field effect transistors, wherein the controlling electrodes are gate electrodes and wherein the pair of controlled electrodes defines a channel between source and drain regions. The first and second transistors preferably include complementary temperature characteristics, and one of the first and second power supply voltages preferably is ground voltage.

By operating one of the transistors above threshold and the other transistor below threshold, the temperature characteristics may complement one another. Moreover, the interconnection of the transistors can compensate for variations of power supply voltage. Finally, since the two transistors are of same conductivity type, variations of the threshold voltages between the two transistors may be reduced, compared to complementary transistors, to thereby produce operation that is relatively insensitive to fabrication process variations.

DETAILED DESCRIPTION OF PREFERRED EMBODIMENTS

Figure 1:
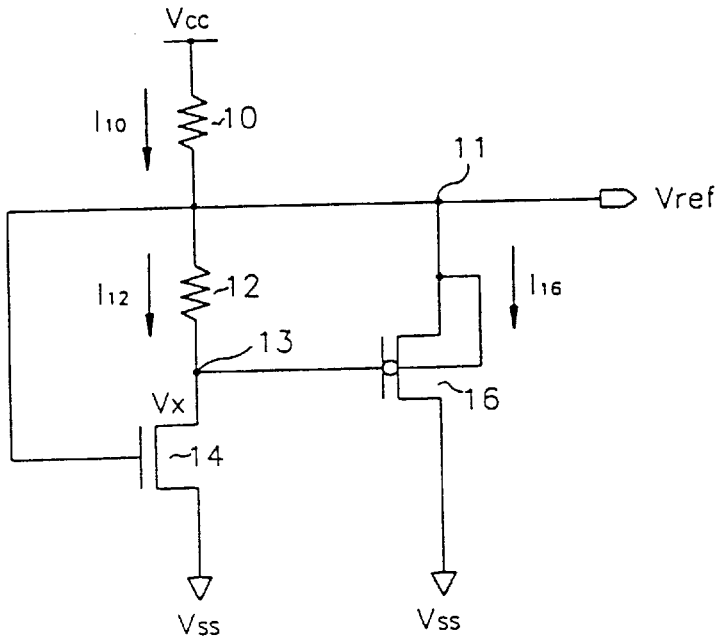
Fig. 1 (Prior Art)
FIG. 1 is a circuit diagram of a conventional reference voltage generator.
Figure 2:
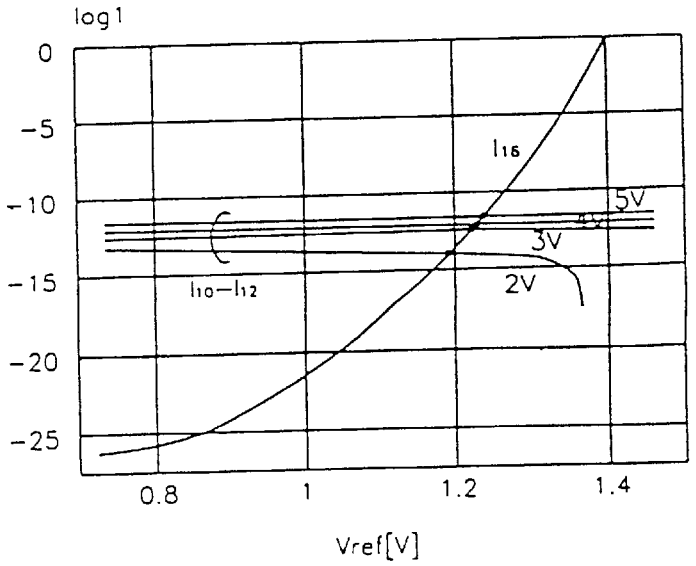
Fig. 2 (Prior Art)
FIG. 2 graphically illustrates variations in reference voltage relative to power supply voltage for the circuit of FIG. 1.
Figure 3:
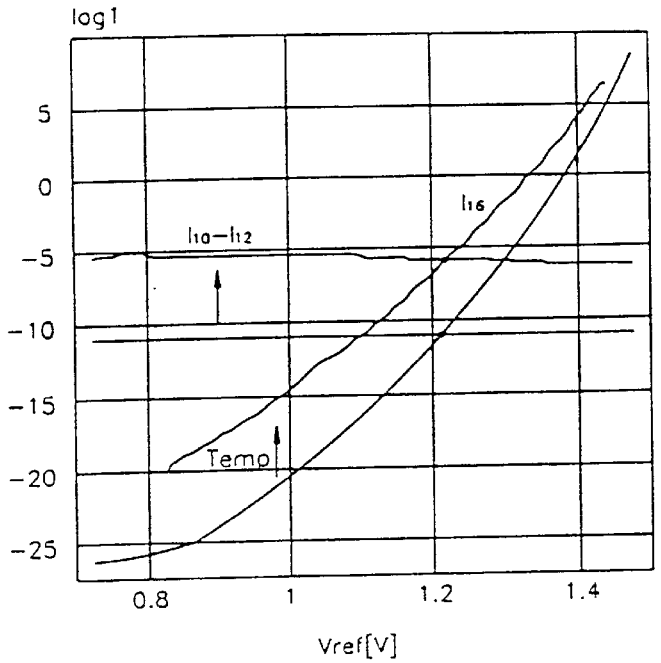
Fig. 3 (Prior Art)
FIG. 3 graphically illustrates variations in reference voltage relative to temperature for the circuit of FIG. 1.
Figure 4:
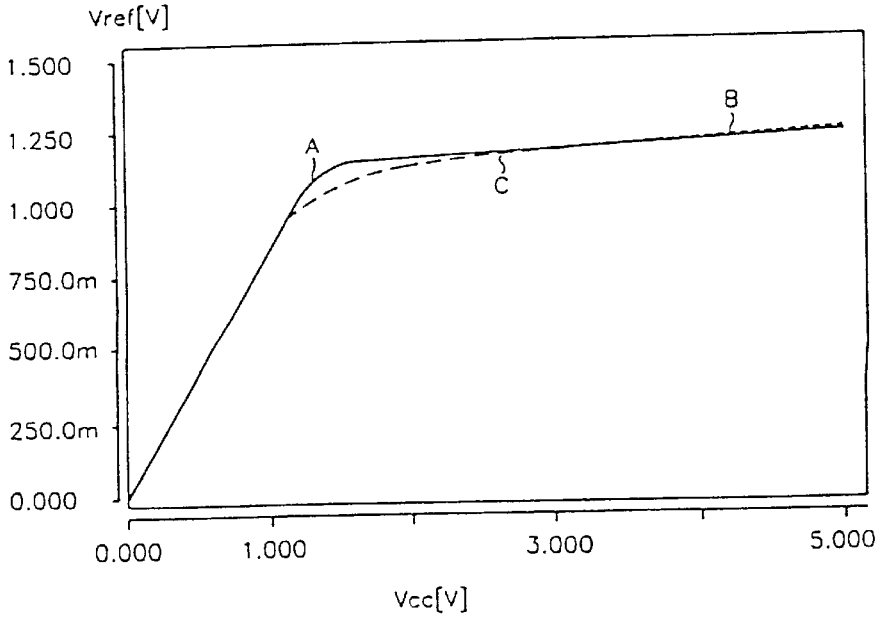
Fig. 4 (Prior Art)
FIG. 4 graphically illustrates variations in reference voltage relative to external power supply voltage for the circuit of FIG. 1.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. Moreover, each embodiment described and illustrated herein includes its complementary conductivity type embodiment as well. For example, although two NMOS transistors are described, two PMOS transistors may also be used.

Figure 6:
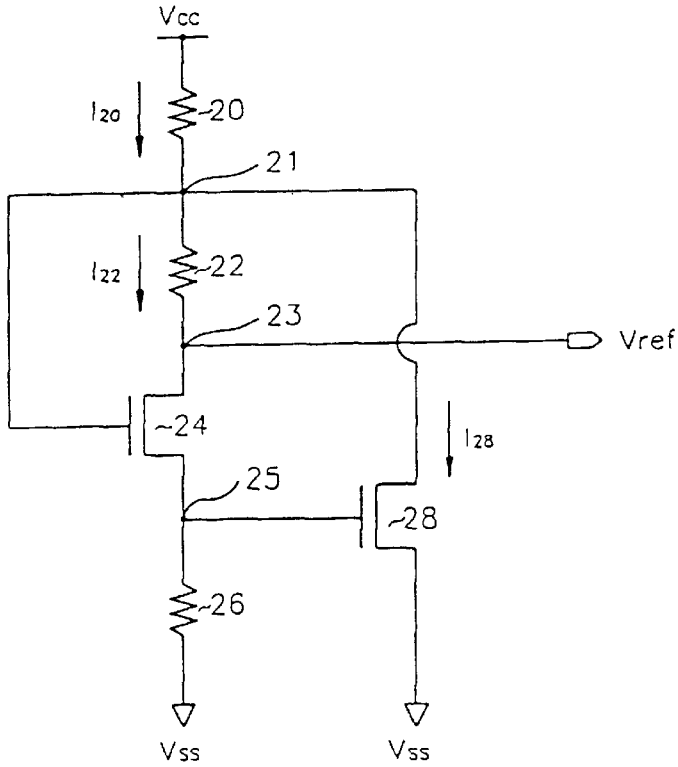
FIG. 6 is a circuit diagram of reference voltage generators according to the present invention.

Referring now to FIG. 6, reference voltage generators according to the present invention include first and second transistors 24 and 28 of same conductivity type, each having a controlled electrode (gate), and a pair of controlled electrodes (source/drain). First, second and third resistors 20, 22 and 26 are also provided. The first and second resistors 20 and 22, the controlled electrodes of the first transistor 24 and the third resistor 26 are serially connected between first and second power supply voltages Vcc and Vss, respectively, to define a first node 21 between the first and second resistors, a reference voltage output terminal 23 (Vref) between the second resistor 22 and the first transistor 24, and a second node 25 between the first transistor 24 and the third resistor 26. More particularly, the drain of NMOS transistor 24 is coupled to reference voltage output terminal 23 and the source of NMOS transistor 24 is connected to ground voltage Vss via resistor 26.

Still continuing with the description of FIG. 6, the controlling electrode of the first transistor 24 is connected to the first node 21 and the controlling electrode of the second transistor 28 is connected to the second node 25. The controlled electrodes of the second transistor 28 are serially connected between the first node 21 and the second power supply voltage Vss. More particularly, the gate of NMOS transistor 28 is connected to the source of NMOS transistor 24 at node 25. The drain of NMOS transistor 28 is connected node 21 and the source of NMOS transistor 28 is connected to ground voltage Vss.

Resistor 26 sets the gate-to-source voltage of NMOS transistor 28 so that NMOS transistor conducts in its subthreshold region. Thus, NMOS transistor 28 has a negative temperature coefficient. In contrast, NMOS transistor 24 has a positive temperature coefficient in its conduction region.

Operation of voltage reference generators according to FIG. 6 will now be described. In particular, if the power supply voltage Vcc increases, the voltage on node 21 (the gate voltage of NMOS transistor 24) increases, and the amount of current I22 through resistor R22 increases. The increase in gate voltage of NMOS transistor 28 due to the higher voltage on node 25 causes an increase in the current I28 through NMOS transistor 28. Thus, the voltage on node 21 is lowered, and current I22 is reduced, which causes the drain-to-source current of NMOS transistor 24 to be reduced. As a result, reference voltage Vref remains relatively constant despite an increase in the power supply voltage Vcc.

Conversely, when Vcc decreases, the reduced voltage level on node 21 decreases current I22. The voltage on node 25 and the voltage Vref also are lowered. However, as the voltage of node 25, corresponding to the gate voltage of NMOS transistor 28, is reduced, the voltage on node 21 is increased and the current through the NMOS transistor 24 increases.

Thus, the two NMOS transistors 24 and 28 adjust to changes in power supply voltage Vcc in a complementary manner, so that the reference voltage Vref is relatively insensitive to power supply voltage variations. Stated differently, NMOS transistor 24 controls the voltage level on node 23 and NMOS transistor 28 controls the voltage level on node 21, so that the reference voltage at node 23 is relatively stable notwithstanding changes in the power supply voltage Vcc.

Figure 7:
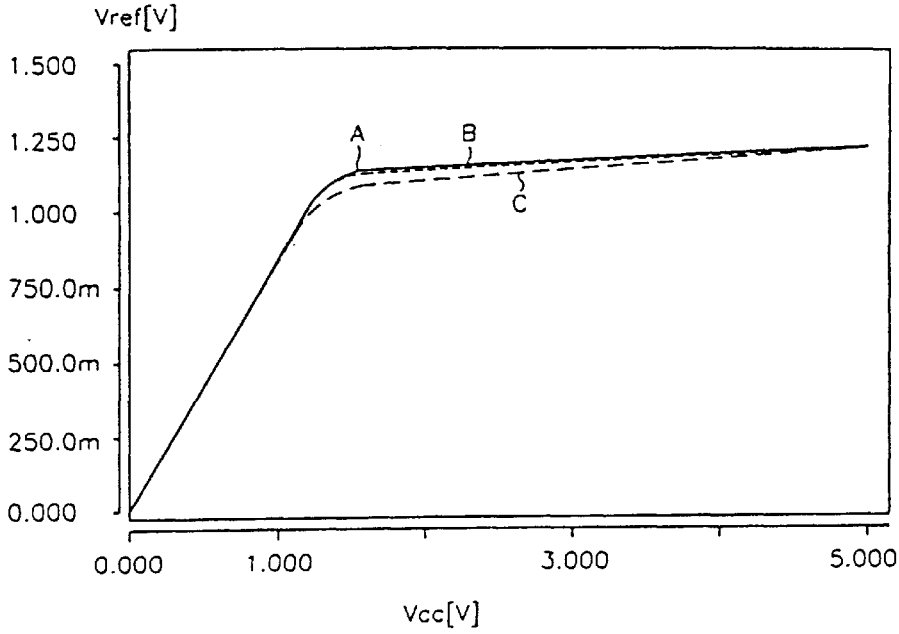
FIG. 7 graphically illustrates variations in reference voltage relative to power supply voltage for circuits of FIG. 6.

FIG. 7 illustrates variations in the reference voltage output Vref relative to temperature variations from 0° C. to 25° C. to 100° C. at A, B and C, respectively. As shown, circuits of FIG. 6 are also relatively insensitive to temperature variation.

Figure 5:
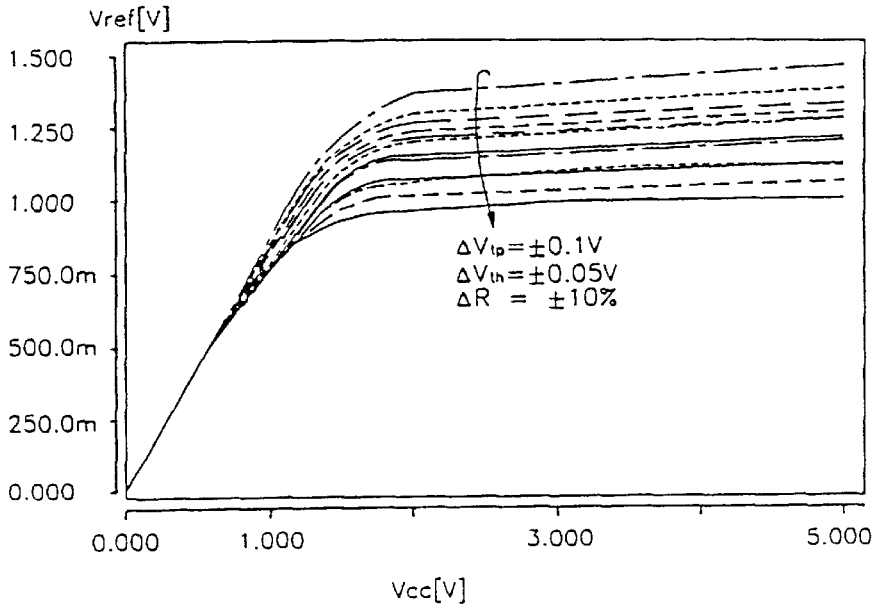
Fig. 5 (Prior Art)
FIG. 5 graphically illustrates variations in reference voltage relative to threshold voltage for the circuit of FIG. 1.
Figure 8:
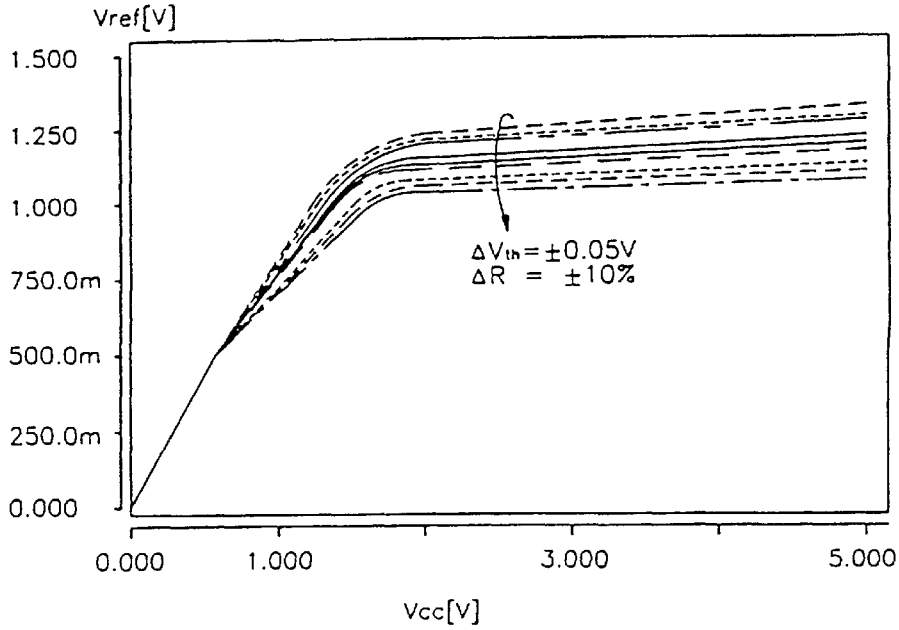
FIG. 8 graphically illustrates variations in reference voltage relative to threshold voltage for circuits of FIG. 6.

FIG. 8 illustrates changes in reference voltage relative to changes in threshold voltages of the transistors 24 and 28. As shown in FIG. 8, and in sharp contrast to FIG. 5, a variation in reference voltage Vref of only about 0.25 volts is produced when the threshold voltage of the NMOS transistors vary by about ±0.05 volts and the resistance value fluctuates within the range of about ±10%.

Accordingly, the present invention can provide stable reference voltages that are relatively insensitive to variations in the threshold voltages of the transistors of the reference voltage generator circuit. The reference voltage can also be relatively insensitive to variations in power supply voltage and temperature.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A reference voltage generator that generates a reference voltage at a reference voltage output terminal thereof, the reference voltage generator comprising:

first and second transistors of same conductivity type, each having a controlling electrode and a pair of controlled electrodes; and first and second nodes, a respective one of which is connected to respective first and second power supply voltages;

the controlled electrodes of the first transistor being connected between the reference voltage output terminal and the second node;

the controlled electrodes of the second transistor being connected between the first node and the second power supply voltage;

the controlling electrode of the first transistor being connected to the first node; and the controlling electrode of the second transistor being connected to the second node;

wherein the first and second transistors include complementary temperature characteristics.

2. A reference voltage generator according to claim 1 wherein one of the first and second power supply voltages is ground voltage.

3. A reference voltage generator that generates a reference voltage at a reference voltage output terminal thereof, the reference voltage generator comprising:

first and second transistors of same conductivity type, each having a controlling electrode and a pair of controlled electrodes; and first and second nodes, a respective one of which is connected to respective first and second power supply voltages;

the controlled electrodes of the first transistor being connected between the reference voltage output terminal and the second node;

the controlled electrodes of the second transistor being connected between the first node and the second power supply voltage;

the controlling electrode of the first transistor being connected to the first node;

the controlling electrode of the second transistor being connected to the second node; and a resistor connected between the second node and the second power supply voltage, and which biases the second transistor in a subthreshold region.

4. A reference voltage generator comprising:

first and second transistors of same conductivity type, each having a controlling electrode and a pair of controlled electrodes; and first, second and third resistors;

the first and second resistors, the controlled electrodes of the first transistor and the third resistor being serially connected between first and second power supply voltages to define a first node between the first and second resistors, a reference voltage output terminal between the second resistor and the first transistor, and a second node between the first transistor and the third resistor;

the controlling electrode of the first transistor being connected to the first node and the controlling electrode of the second transistor being connected to the second node; and the controlled electrodes of the second transistor being serially connected between the first node and the second power supply voltage.

5. A reference voltage generator according to claim 4 wherein the first and second transistors are first and second field effect transistors, wherein the controlling electrodes are gate electrodes and wherein the pair of controlled electrodes defines a channel.

6. A reference voltage generator according to claim 4 wherein the first and second transistors include complementary temperature characteristics.

7. A reference voltage generator according to claim 4 wherein one of the first and second power supply voltages is ground voltage.

8. A reference voltage generator according to claim 4 wherein the third resistor biases the second transistor in a subthreshold region.

* * * * *